US010878744B2

(12) United States Patent
Cheng et al.

(10) Patent No.: US 10,878,744 B2
(45) Date of Patent: Dec. 29, 2020

(54) PIXEL DRIVING CIRCUIT AND OPERATING METHOD THEREOF

(71) Applicant: AU OPTRONICS CORPORATION, Hsin-Chu (TW)

(72) Inventors: Mao-Hsun Cheng, Hsin-Chu (TW); Cheng-Han Huang, Hsin-Chu (TW); Mei-Sheng Ma, Hsin-Chu (TW); Yi-Chiung Chen, Hsin-Chu (TW); Hsiang-Sheng Chang, Hsin-Chu (TW); Po-Jung Wu, Hsin-Chu (TW); Yung-Chih Chen, Hsin-Chu (TW); Ching-Sheng Cheng, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/683,505

(22) Filed: Nov. 14, 2019

(65) Prior Publication Data

US 2020/0226974 A1 Jul. 16, 2020

(30) Foreign Application Priority Data

Jan. 15, 2019 (TW) ..... 108101541 A

(51) Int. Cl.
*G09G 3/32* (2016.01)

(52) U.S. Cl.
CPC ..... *G09G 3/32* (2013.01); *G09G 2300/08* (2013.01); *G09G 2310/0264* (2013.01); *G09G 2310/061* (2013.01); *G09G 2320/0233* (2013.01)

(58) Field of Classification Search
CPC .. G09G 3/3233; G09G 3/3258; G09G 3/3241; G09G 2300/0819; G09G 2300/0852; G09G 2300/0861; G09G 2300/0426; G09G 2300/043; G09G 2310/0256; G09G 2310/0262; G09G 2310/0251; G09G 2320/043; G09G 2320/045; G09G 2320/0223
See application file for complete search history.

(56) References Cited

U.S. PATENT DOCUMENTS

| | | | | |
|---|---|---|---|---|
| 9,478,169 | B2 * | 10/2016 | Lim | H01L 27/124 |
| 9,627,465 | B2 | 4/2017 | Kwon et al. | |
| 2004/0129933 | A1 * | 7/2004 | Nathan | G09G 3/3241 257/40 |
| 2010/0079361 | A1 * | 4/2010 | Lee | G09G 3/3233 345/77 |
| 2013/0057532 | A1 * | 3/2013 | Lee | G09G 3/3225 345/211 |

(Continued)

FOREIGN PATENT DOCUMENTS

| | | |
|---|---|---|
| CN | 105280141 B | 1/2016 |
| CN | 108133686 A | 6/2018 |

OTHER PUBLICATIONS

Office Action issued by SIPO for the corresponding China application dated Mar. 31, 2020.

*Primary Examiner* — Dong Hui Liang
(74) *Attorney, Agent, or Firm* — WPAT, PC

(57) ABSTRACT

A pixel driving circuit utilizing a transistor having two gate ends as the driving unit for pixels of a display panel to provide a stable driving current to compensate for the variation of threshold voltages of transistors in different pixels and to improve the uniformity of the brightness of the display panel.

20 Claims, 11 Drawing Sheets

(56) References Cited

U.S. PATENT DOCUMENTS

| | | | | |
|---|---|---|---|---|
| 2014/0346968 | A1* | 11/2014 | Meng | G09G 3/3233 315/240 |
| 2015/0187276 | A1* | 7/2015 | Shim | G09G 3/3291 345/77 |
| 2015/0255523 | A1 | 9/2015 | Her | |
| 2019/0213944 | A1* | 7/2019 | Zhou | H01L 27/124 |

* cited by examiner

PIXEL DRIVING CIRCUIT AND OPERATING METHOD THEREOF

BACKGROUND

Technical Field

The present invention relates to a pixel driving circuit and an operating method thereof; in particular, the present invention relates to a pixel driving circuit having a light emitting diode display device and an operating method thereof.

Description of Related Art

In general, a light emitting diode display device has a data circuit, a scanning circuit, and a pixel driving circuit. The pixel driving circuit drives the light emitting diode to emit light according to the data signal provided by the data circuit and the scanning signal provided by the scanning circuit. In general, the driving current of the light emitting diode is related to the data signal and the threshold voltage of the transistor in the pixel driving circuit. However, the threshold voltage is often biased by manufacturing process factors to affect the actual brightness of the light emitting diode, which affects the uniformity of the brightness of the display panel. Therefore, improving the uniformity of the brightness of the display panel and reducing the circuit layout area are major subjects for improvement.

SUMMARY

An objective of the present disclosure is to provide a pixel driving circuit and an operating method thereof that can provide a stable driving current.

The pixel driving circuit includes a driving unit, a capacitor, a compensation unit, a first switch unit, a second switch unit, a third switch unit and a light emitting element. The driving unit includes a first end, a second end, a first control end and a second control end. The first end of the driving unit receives a first supply voltage. The first control end of the driving unit receives a first control signal and biases the driving unit according to the first control signal. One end of the capacitor is connected to the second control end of the driving unit, and the other end is connected to the first end of the driving unit or the second end of the driving unit. The compensation unit includes a first end, a second end, a first control end and a second control end. The first control end of the compensation unit receives a second control signal and biases the compensation unit according to the second control signal. The second control end of the compensation unit is connected to the second end of the compensation unit and connected to the second control end of the driving unit. The first switch unit includes a first end, a second end and a control end. The first end of the first switch unit receives a data signal. The second end of the first switch unit is connected to the first end of the compensation unit. The control end of the first switch unit receives a third control signal and turns on the first switch unit according to the third control signal. The second switch unit includes a first end, a second end and a control end. The first end of the second switch unit is connected to the second end of the compensation unit. The second end of the second switch unit is connected to the first initial voltage. The control end of the second switch unit receives a fourth control signal and turns on the second switch unit according to the fourth control signal. The third switch unit includes a first end, a second end and a control end. The first end of the third switch unit is connected to the second end of the driving unit. The second end of the third switch unit is connected to a second initial voltage. The control end of the third switch unit receives the third control signal or the fourth control signal. The third switch unit is turned on according to the fourth control signal. The light emitting element includes an anode end and a cathode end. The anode end is connected to the second end of the driving unit. The cathode end receives a second supply voltage. In a detecting phase, the compensation unit and the first switch unit are turned on and the driving unit is not turned on to provide the data signal to the second control end of the compensation unit. In a light emitting phase, the first switch unit is not turned on and the driving unit is turned on to provide a driving current to the light emitting element.

The pixel driving circuit includes a first transistor, a second transistor, a third transistor, a fourth transistor, a fifth transistor, a capacitor and a light emitting element. The first transistor includes a first end receiving the first supply voltage and a first gate end receiving the first control signal, wherein the first gate end biases the first transistor according to the first control signal. One end of the capacitor is connected to the second gate end of the first transistor, and the other end is connected to the first end of the transistor or the second end of the first transistor. The second transistor includes a first gate end receiving the second control signal, wherein the first gate end biases the second transistor according to the second control signal, and a second gate end connected to both the second end of the second transistor and the second gate end of the first transistor. The third transistor includes a first end receiving the data signal, a second end connected to the first end of the second transistor, and a gate end receiving the third control signal and turning on the third transistor according to the third control signal. The fourth transistor includes a first end connected to the second end of the second transistor, a second end connected to the first initial voltage, and a gate end receiving the fourth control signal and turning on the fourth transistor according to the fourth control signal to reset the second gate end of the first transistor. The fifth transistor includes a first end connected to the second end of the first transistor, a second end connected to the second initial voltage, and a gate end receiving the third control signal or the fourth control signal. The light emitting element includes an anode end electrically connected to the first end of the fifth transistor and a cathode end receiving the second supply voltage. The fifth transistor is turned on according to the fourth control signal to reset the anode end of the light emitting element.

The operating method includes the following steps: (A) in the first operating state, resetting the second gate end of the first transistor via the fourth transistor; (B) in the second operating state, providing the data signal to the second gate end of the second transistor via the second transistor and the third transistor; and (C) in the third operating state, providing a driving current to the light emitting element via the first transistor.

DETAILED DESCRIPTION

The pixel driving circuit according to the present invention will be described in detail below through embodiments and with reference to the accompanying drawings, but the embodiments are not intended to limit the scope of the present disclosure. Unless otherwise defined, all terms (including technical and scientific terms) used herein have the same meanings as commonly understood by one of ordinary skill in the art to which the present invention belongs. It will be further understood that terms such as those defined in commonly used dictionaries should be interpreted as having a meaning that is consistent with their meaning in the context of the relevant art and the present invention and will not be interpreted in an idealized or overly formal sense unless expressly so defined herein.

As used herein, the terms such as "first" and "second" and the like do not particularly refer to an order or sequence, and are not intended to limit the present invention, but are merely used for the purpose of distinguishing elements or operations that are described in the same technical language. As used herein, "comprise", "include", "have", and any variants thereof are open-ended terms and refer to "include, but not limited to". As used herein, "and/or" means including any or all combinations of the items listed.

Unless otherwise particularly indicated, the terms, as used herein, generally have the meanings that would be commonly understood by those of ordinary skill in the art. Some terms used to describe the present disclosure are discussed below or elsewhere in this specification to provide additional guidance to those skilled in the art in connection with the description of the present disclosure.

Figure 1:
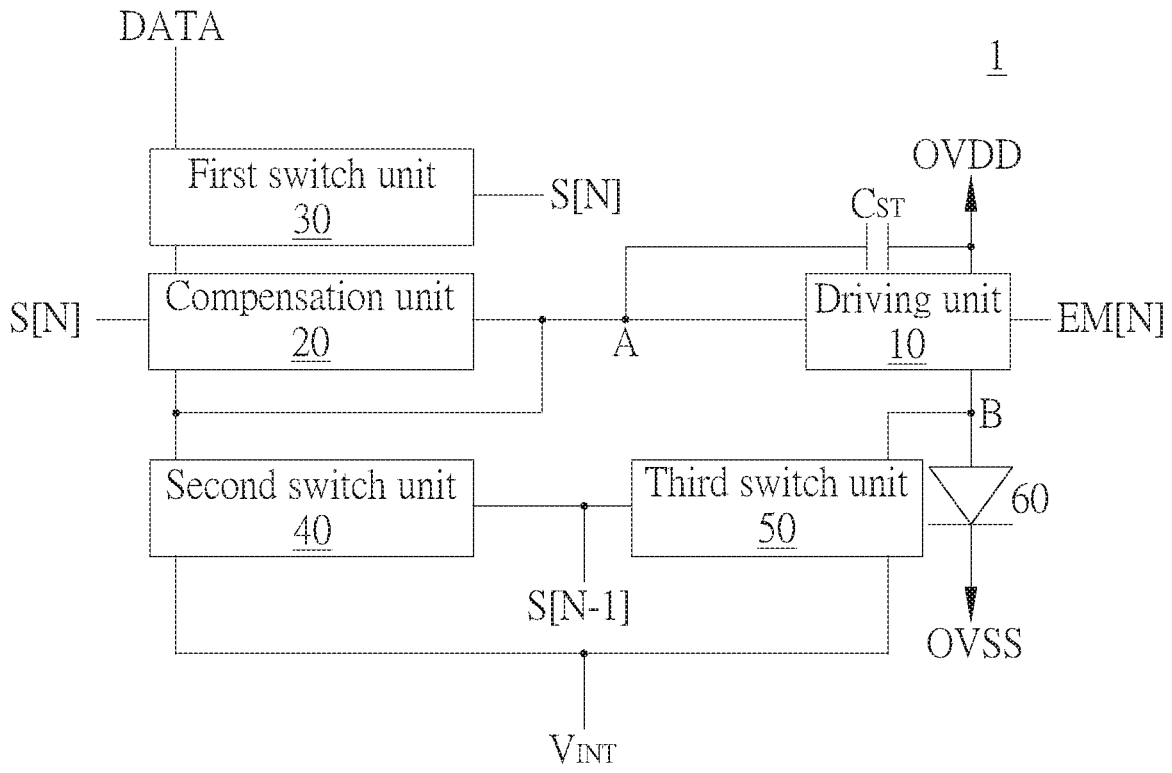
FIG. 1 is a schematic diagram of an embodiment of a pixel driving circuit of the present invention.

FIG. 1 is a schematic diagram of an embodiment of a pixel driving circuit 1 of the present invention. As shown in FIG. 1, the pixel driving circuit 1 includes a driving unit 10, a capacitor $C_{ST}$, a compensation unit 20, a first switch unit 30, a second switch unit 40, a third switch unit 50 and a light emitting element 60. The driving unit 10 includes a first end, a second end, a first control end and a second control end. The driving unit 10 receives a supply voltage OVDD via the first end, and the first control end receives the control signal EM[N] and turns on the driving unit 10 according to the control signal EM[N]. One end of the capacitor $C_{ST}$ is connected to the second control end of the driving unit 10. Further, in the embodiment of FIG. 1, the other end of the capacitor $C_{ST}$ is connected to the first end of the driving unit 10.

The compensation unit 20 includes a first end, a second end, a first control end and a second control end. The compensation unit 20 receives a control signal S[N] via the first control end, and turns on the compensation unit 20 according to the control signal S[N]. The second control end of the compensation unit 20 is connected to the second end of the compensation unit 20 and the second control end of the driving unit 10.

The first switch unit 30 includes a first end, a second end and a control end. The first switch unit 30 receives a data signal DATA via the first end, the second end of the first switch unit 30 is connected to the first end of the compensation unit 20, and the control end of the first switch unit 30 receives the control signal S[N] and turns on the first switch unit 30 according to the control signal S[N].

The second switch unit 40 includes a first end, a second end and a control end. The first end of the second switch unit 40 is connected to the second end of the compensation unit 20. The second end of the second switch unit 40 is connected to a first initial voltage $V_{INT}$. The control end of the second switch unit 40 receives a control signal S[N−1] and turns on the second switch unit 40 according to the control signal S[N−1].

The third switch unit 50 includes a first end, a second end and a control end. The first end of the third switch unit 50 is connected to the second end of the driving unit 10, and the second end of the third switch unit 50 is connected to the initial voltage $V_{INT}$. In the embodiment of FIG. 1, the initial voltages to which the second switch unit 40 and the third switch unit 50 are connected are the same voltage source. The control end of the third switch unit 50 receives the control signal S[N−1] and turns on the third switch unit 50 according to the control signal S[N−1]. The light emitting element 60 includes an anode end and a cathode end. The anode end of the light emitting element 60 is connected to the second end of the driving unit 10, and the cathode end receives the supply voltage OVSS.

Figure 2:
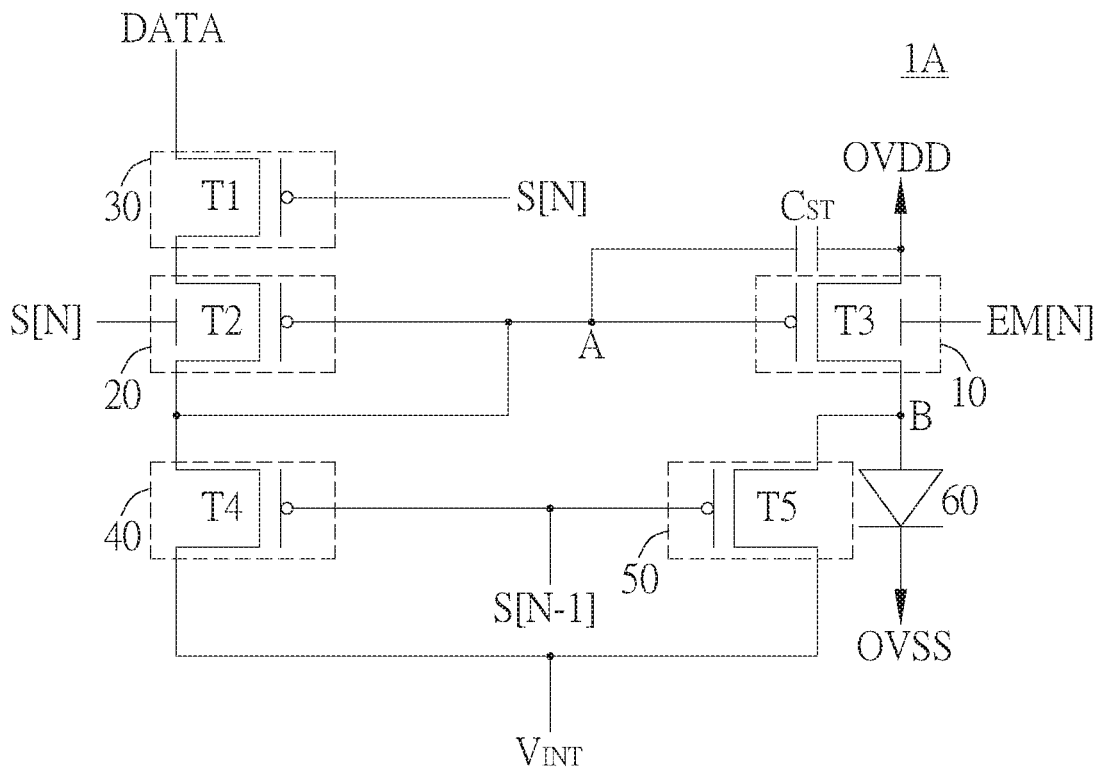
FIG. 2 is a schematic diagram of another embodiment of a pixel driving circuit.

Please refer to FIG. 2. FIG. 2 is a schematic diagram of another embodiment of a pixel driving circuit 1A. Taking FIG. 2 as an example, the pixel driving circuit 1A illustrated in FIG. 2 can be applied to the pixel driving circuit shown in FIG. 1. As shown in FIG. 2, the driving unit 10 of the pixel driving circuit 1A may include a transistor T3. The transistor T3 includes a first end, a second end, a first gate end and a second gate end. The first end of the transistor T3 receives the supply voltage OVDD. The first gate end of the transistor T3 receives the control signal EM[N] and turns on the transistor T3 according to the control signal EM[N]. One end of the capacitor $C_{ST}$ is connected to the second gate end of the transistor T3. Further, in the embodiment of FIG. 2, the other end of the capacitor $C_{ST}$ is connected to the first end of the transistor T3.

The compensation unit 20 may include a transistor T2. The transistor T2 includes a first end, a second end, a first gate end and a second gate end. The first gate end of the transistor T2 receives the control signal S[N] and biases the transistor T2 according to the control signal S[N]. The second gate end of the transistor T2 is connected to the second end of the transistor T2 and the second gate end of the transistor T3.

The first switch unit 30 may include a transistor T1. The transistor T1 includes a first end, a second end and a gate end. The first end of the transistor T1 receives the data signal DATA. The second end of the transistor T1 is connected to the first end of the transistor T2. The gate end of the transistor T1 receives the control signal S[N] and turns on the transistor T1 according to the control signal S[N]. In the embodiment of FIG. 2, the control signal received by the transistor T2 is the same as the control signal received by the transistor T1.

The second switch unit 40 may include a transistor T4. The transistor T4 includes a first end, a second end and a gate end. The first end of the transistor T4 is connected to the second end of the transistor T2. The second end of the transistor T4 is connected to the initial voltage $V_{INT}$. The gate end of the transistor T4 receives the control signal S[N−1] and turns on the transistor T4 according to the control signal S[N−1] to reset the second gate end of the transistor T3.

The third switch unit 50 may include a transistor T5. The transistor T5 includes a first end, a second end and a gate end. The first end of the transistor T5 is connected to the second end of the transistor T3. The second end of the transistor T5 is connected to the initial voltage $V_{INT}$. In the embodiment of FIG. 2, the initial voltages to which the transistor T4 and the transistor T5 are connected are the same voltage source. Both the second end of the transistor T4 and the second end of the transistor T5 are directly connected to the initial voltage $V_{INT}$. The gate end of the transistor T5 receives the control signal S[N−1].

The anode end of the light emitting element 60 is electrically connected to the first end of the transistor T5 and the second end of the transistor T3. The cathode end of the light emitting element 60 receives the supply voltage OVSS. The transistor T5 is turned on according to the control signal S[N−1] to reset the anode end of the light emitting element 60.

Figure 3:
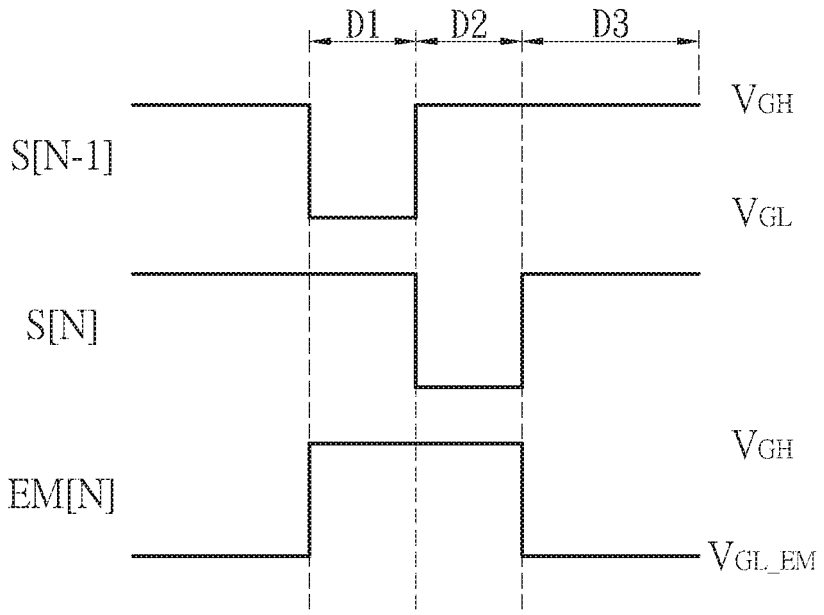
FIG. 3 is a schematic diagram of a pixel driving circuit signal.

FIG. 3 is a schematic diagram of a pixel driving circuit signal. As shown in FIG. 3, the operation of the pixel driving circuit can be divided into three operating states according to different periods, which are a first operating state (i.e., resetting phase), a second operating state (i.e., detecting phase) and a third operating state (i.e., light emitting phase) in order. The change in the operating state is achieved by adjusting the level of each control signal in the period D1, the period D2 and the period D3 respectively.

Figure 4:
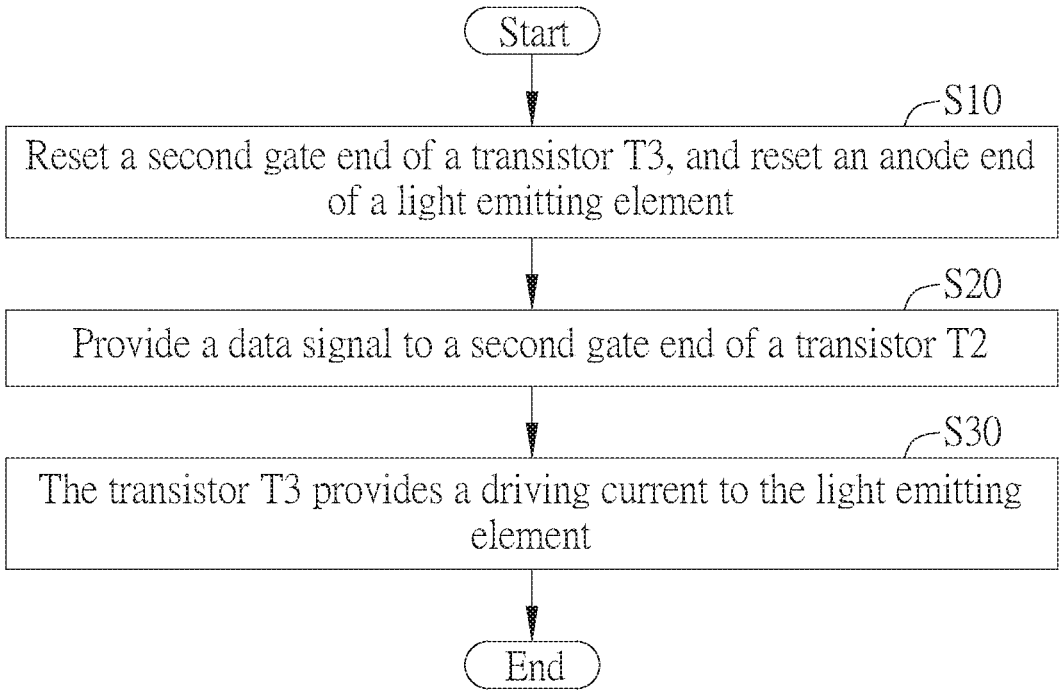
FIG. 4 is a flow chart of an operating method of a pixel driving circuit.

FIG. 4 is a flow chart of an operating method of a pixel driving circuit. As shown in FIG. 4, referring to the embodiment of FIG. 3, in step S10, in the first operating state, the second gate end of the transistor T3 is reset via the transistor T4, and the anode end of the light emitting element 60 is reset via the transistor T5. In step S20, in the second operating state, the data signal DATA is provided to the second gate end of the transistor T2 via the transistor T2 and the transistor T1. In step S30, in the third operating state, the driving current is provided to the light emitting element 60 via the transistor T3.

Figure 5A:
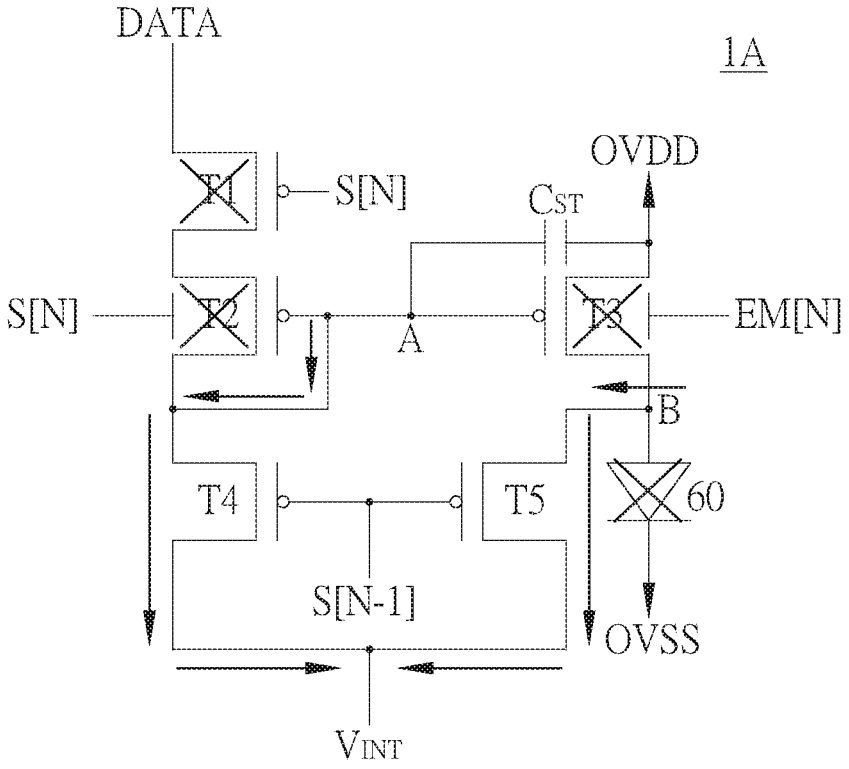
FIG. 5A to FIG. 5C are schematic diagrams illustrating the pixel driving circuit in different operation modes corresponding to FIG. 2.
Figure 5B:
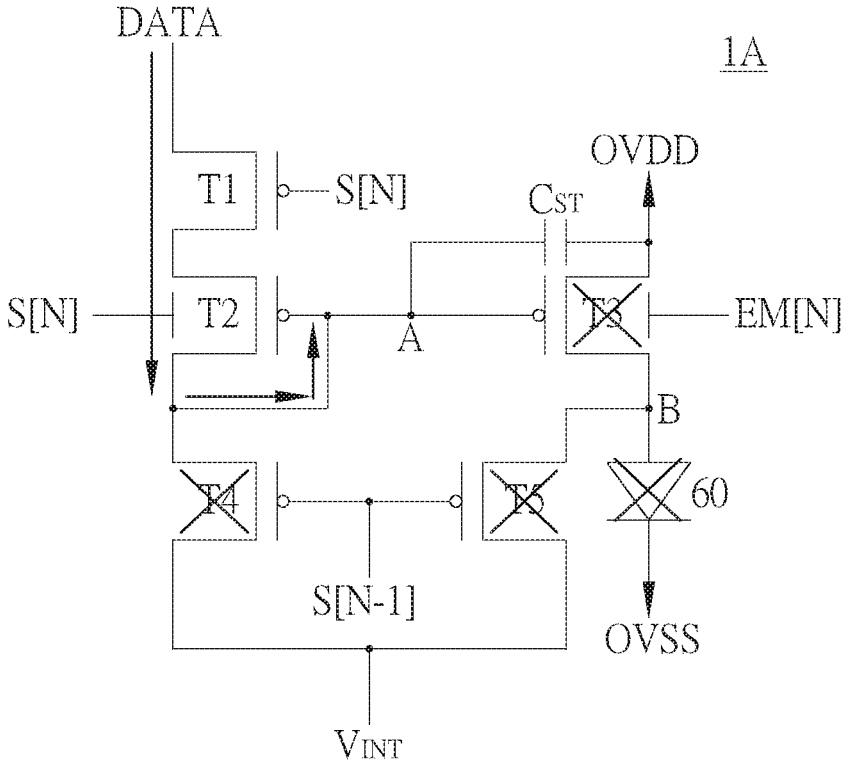
Figure 5C:
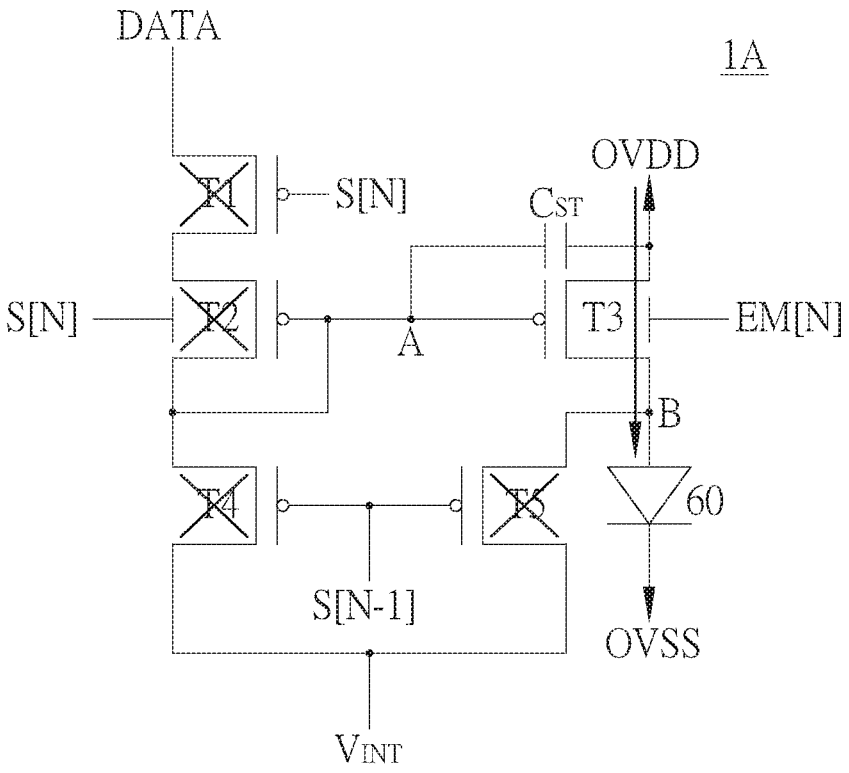

FIG. 5A to FIG. 5C are schematic diagrams showing the pixel driving circuit in different operation modes corresponding to FIG. 2. Referring to FIG. 3 and FIG. 5A, in the period D1, the control signal S[N−1] is changed from a high voltage level ($V_{GH}$) to a low voltage level ($V_{GL}$), the control signal S[N] is maintained at a high voltage level ($V_{GH}$), and the control signal EM[N] is changed from a low voltage level ($V_{GL_EM}$) to a high voltage level ($V_{GH}$). As shown in FIG. 5A, at this time, the transistor T1, the transistor T2 and the transistor T3 are in an off state, and the transistor T4 and the transistor T5 are in an on state.

Further, in the aforementioned flow of the first operating state (i.e., resetting phase), the control signal S[N−1] is provided to turn on the transistor T4, and the second gate end of the transistor T3 receives the initial voltage $V_{INT}$. In addition, the control signal S[N−1] is provided to turn on the transistor T5, and the anode end of the light emitting element 60 receives the initial voltage $V_{INT}$. As seen from another perspective (referring to FIG. 2), the second control end of the driving unit 10 is reset via the second switch unit 40, and the anode end of the light emitting element 60 is reset via the third switch unit 50. The potential at point A after resetting is equal to $V_{INT}$, and the potential at point B after resetting is equal to $V_{INT}$.

It should be noted that, in the embodiments shown in FIG. 2 and FIG. 5A to FIG. 5C, the transistor T1, the transistor T2, the transistor T3, the transistor T4 and the transistor T5 are transistors of the same type. Referring to FIG. 3 and FIG. 5A, in the first operating state, the waveform of the control signal EM[N] is in opposite phase with that of the control signal S[N−1]. Thereby the aforementioned first operating state is completed.

Referring to FIG. 3 and FIG. 5B, in the period D2, the control signal S[N−1] is changed from a low voltage level ($V_{GL}$) to a high voltage level ($V_{GH}$), the control signal S[N] is changed from a high voltage level ($V_{GH}$) to a low voltage level ($V_{GL}$), and the control signal EM[N] is maintained at a high voltage level ($V_{GH}$). In the second operating state, the waveform of the control signal EM[N] is in opposite phase with that of the control signal S[N]. Thereby the aforementioned second operating state is completed. As shown in FIG. 5B, at this time, the transistor T1 and the transistor T2 are in an on state, and the transistor T3, the transistor T4 and the transistor T5 are in an off state.

Further, in the aforementioned flow of the second operating state (i.e., detecting phase), the control signal S[N] is provided to bias the transistor T2. On the other hand, the control signal S[N] is provided to turn on the transistor T1, whereby the second gate end of the transistor T3 receives the data signal DATA. As seen from another perspective (referring to FIG. 2), the compensation unit 20 and the first switch unit 30 are turned on and the driving unit 10 is not turned on, thereby providing the data signal DATA to the second control end of the compensation unit 20. In this stage, the potential at point A is equal to DATA-$|V_{th_T2}|$, and the potential at point B is equal to $V_{INT}$, wherein $V_{th_T2}$ is the threshold voltage of the transistor T2.

Referring to FIG. 3 and FIG. 5C, in the period D3, the control signal S[N−1] is maintained at a high voltage level ($V_{GH}$), the control signal S[N] is changed from a low voltage level ($V_{GL}$) to a high voltage level ($V_{GH}$), and the control signal EM[N] is changed from a high voltage level ($V_{GH}$) to a low voltage level ($V_{GL_EM}$). As shown in FIG. 5C, at this time, the transistor T1, the transistor T2, the transistor T4 and the transistor T5 are in an off state, and the transistor T3 is in an on state. As seen from another perspective (referring to FIG. 2), in the period D3, the first switch unit 30 is not turned on and the driving unit 10 is turned on, thereby providing a driving current to the light emitting element 60. In this stage, the potential at point A is equal to DATA-$|V_{th_T2}|$, and the driving current is in accordance with: $I=(1/2)k(OVDD-DATA)^2$. It should be understood that the driving current is generally related to the supply voltage and the threshold voltage value of the driving transistor, and by using the transistor T2 and the transistor T3 with the same threshold voltage value, the influence of the threshold voltage value of the transistor is eliminated in the driving current, thereby providing a stable driving current and improving the display quality.

Take for example a display device for forming a low-temperature polysilicon thin film transistor. When the two transistors are in close proximity, the laser energy received from laser irradiation is relatively close, thereby making the threshold voltages of the transistors highly uniform. It should be additionally noted that, the voltage level ($V_{GL_EM}$) of the control signal EM[N] in the third operating state (i.e., light emitting phase) must be the same as the voltage level ($V_{GL}$) of the control signal S[N] in the second operating state (i.e., detecting phase). The voltage level is set such that the transistor T2 and the transistor T3 are operated in the saturation region. In addition, the bias condition of the first gate end of the transistor T2 in the second operating state (i.e., detecting phase) and the bias condition of the first gate end of the transistor T3 in the third operating state (i.e., light emitting phase) are consistent. Therefore, the threshold voltage value of the transistor T2 and the threshold voltage value of the transistor T3 are more consistent, thereby providing a better threshold voltage compensation effect.

Figure 6:
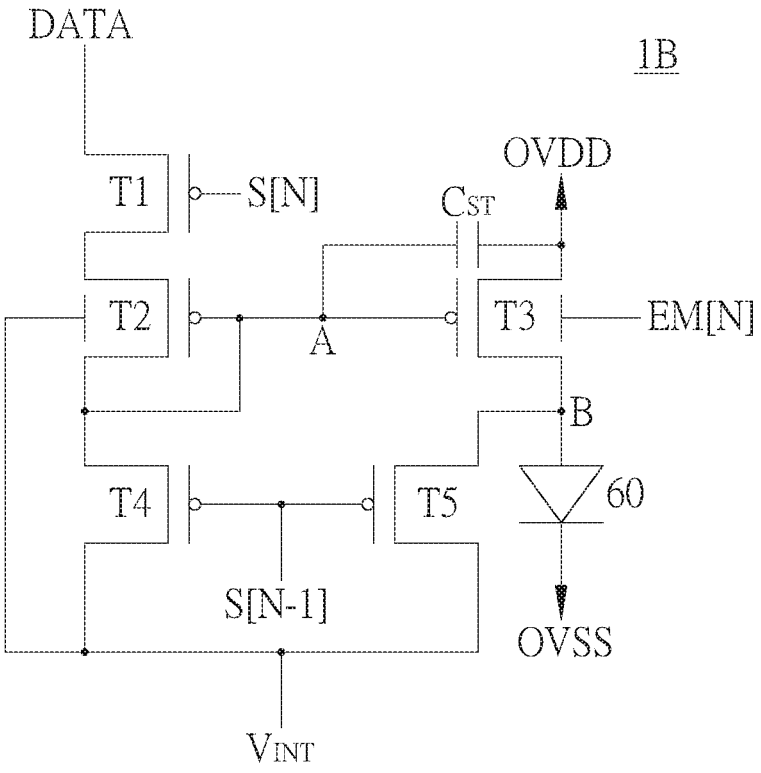
FIG. 6 to FIG. 9 are schematic diagrams of different embodiments of a pixel driving circuit.

FIG. 6 to FIG. 9 are schematic diagrams of different embodiments of a pixel driving circuit. As shown in FIG. 6, the pixel driving circuit 1B includes a transistor T1, a transistor T2, a transistor T3, a transistor T4, a transistor T5, a capacitor $C_{ST}$ and a light emitting element 60. The inter-element connection relationship of the pixel driving circuit 1B illustrated in FIG. 6 is substantially the same as the inter-element connection relationship of the pixel driving circuit 1A. The difference from the previous embodiment is that the first gate end of the transistor T2 is connected to the second end of the transistor T4. In the embodiment of FIG. 6, both the second end of the transistor T4 and the second end of the transistor T5 are directly connected to the initial voltage $V_{INT}$. The control signal received by the transistor T2 is different from the control signal received by the transistor T1. The control signal received by the transistor T2 is the initial voltage $V_{INT}$, and the gate end of the transistor T1 receives the control signal S[N].

It should be noted that, in the embodiment of FIG. 6, the voltage level ($V_{GL_EM}$) of the control signal EM[N] in the third operating state (i.e., light emitting phase) needs to be the same as the voltage level of the initial voltage $V_{INT}$, thereby completing the aforementioned operating flow. That is, the voltage level of the EM[N] signal in the third operating state must be the same as the voltage level of the first gate end of the T2 in the second operating state, but the high voltage levels of both control signals are $V_{GH}$.

In other embodiments, the pixel driving circuit may have the same inter-element connection relationship with the pixel driving circuit 1A, and the control signal received by the transistor T2 is a reference voltage. The voltage level ($V_{GL_EM}$) of the control signal EM[N] in the third operating state (i.e., light emitting phase) must be the same as the voltage level of the reference voltage, thereby completing the aforementioned operating flow.

Figure 7:
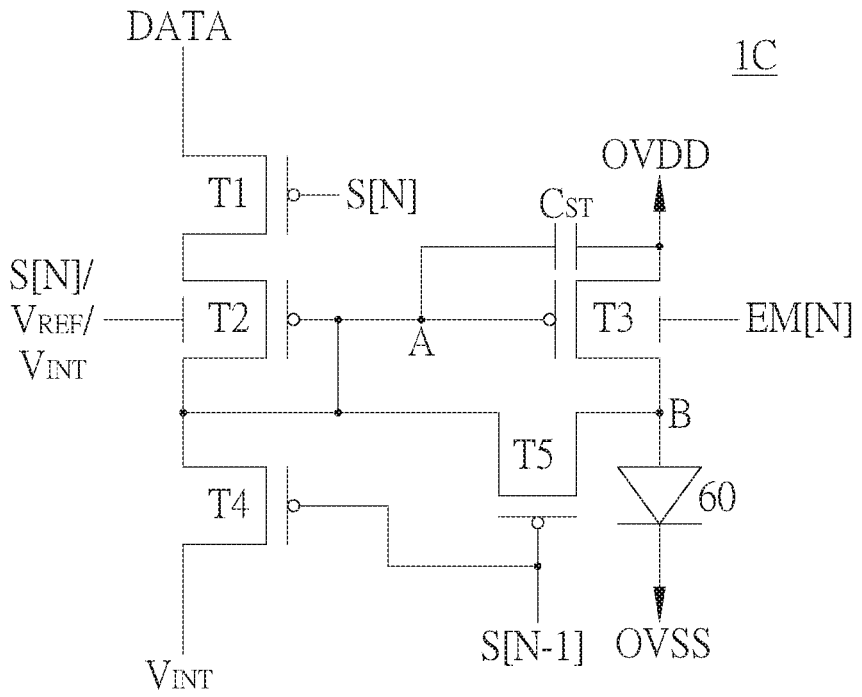

As shown in FIG. 7, the pixel driving circuit 1C includes a transistor T1, a transistor T2, a transistor T3, a transistor T4, a transistor T5, a capacitor $C_{ST}$ and a light emitting element 60. The inter-element connection relationship of the pixel driving circuit 1C illustrated in FIG. 7 is substantially the same as the inter-element connection relationship of the pixel driving circuit 1A. The difference from the pixel driving circuit 1A is that the second end of the transistor T5 is connected to the first end of the transistor T4. In other words, the transistor T5 receives the initial voltage $V_{INT}$ via the transistor T4. The difference in the operating flow is that, in the embodiment of FIG. 7, due to the on-resistance of the two transistors, in the first operating state (i.e., resetting phase), the potential at point B after resetting is higher than the initial voltage $V_{INT}$. It should be understood that, in the aforementioned case, it is still necessary to maintain the light emitting element 60 not turned on in the first operating state, that is, satisfying $VB-OVSS<V_{TH_OLED}$, where the $V_{TH_OLED}$ is the threshold voltage of the light emitting element 60.

Figure 8:
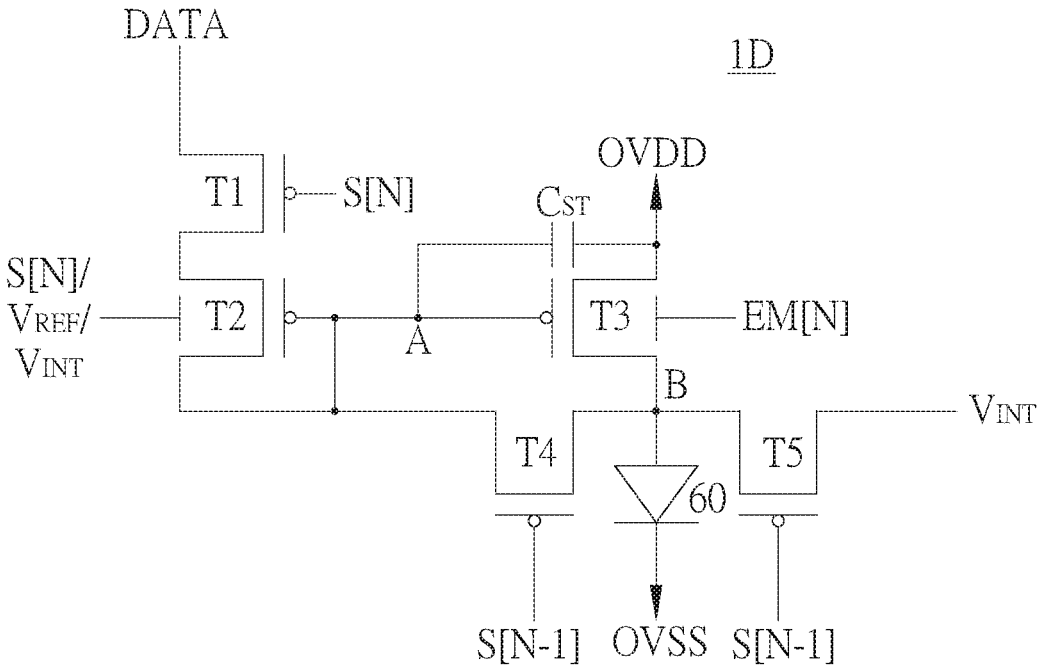

As shown in FIG. 8, the pixel driving circuit 1D includes a transistor T1, a transistor T2, a transistor T3, a transistor T4, a transistor T5, a capacitor $C_{ST}$ and a light emitting element 60. The inter-element connection relationship of the pixel driving circuit 1D illustrated in FIG. 8 is substantially the same as the inter-element connection relationship of the pixel driving circuit 1A. The difference from the pixel driving circuit 1A is that the second end of the transistor T4 is connected to the first end of the transistor T5. In other words, the transistor T4 receives the initial voltage $V_{INT}$ via the transistor T5. The difference in the operating flow is that in the first operating state (i.e., resetting phase), the potential at point A after resetting is higher than the initial voltage $V_{INT}$. In addition, as described above, the control signal received by the transistor T2 may be the reference voltage $V_{REF}$, the initial voltage $V_{INT}$, or the same as the control signal received by the transistor T1. Further, when the transistors of the pixel driving circuit are of the same type (for example, the pixel driving circuits 1A to 1D), the control signal received by the transistor T2 may be the same as or different from the control signal S[N] received by the transistor T1.

Figure 9:
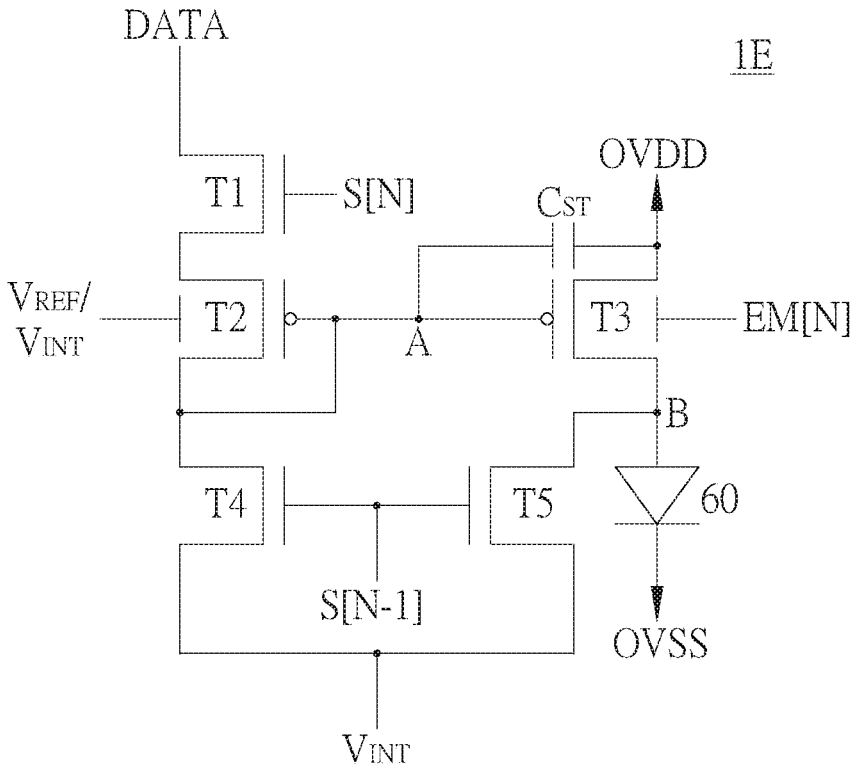

As shown in FIG. 9, the pixel driving circuit 1E includes a transistor T1, a transistor T2, a transistor T3, a transistor T4, a transistor T5, a capacitor $C_{ST}$ and a light emitting element 60. The inter-element connection relationship of the pixel driving circuit 1E illustrated in FIG. 9 is the same as the inter-element connection relationship of the pixel driving circuit 1A. The difference from the aforementioned embodiment is that the transistor T1, the transistor T2, the transistor T3, the transistor T4 and the transistor T5 are transistors of different types. In general, the transistor T3 and the transistor T2 are transistors of the same type, and the transistor T1, the transistor T4 and the transistor T5 are transistors of the same type but different from the transistor T3 (and the transistor T2). In the embodiment shown in FIG. 9, the transistor T3 and the transistor T2 are P-type transistors, and the transistor T1, the transistor T4 and the transistor T5 are N-type transistors.

Further, in the embodiment of FIG. 9, the initial voltages to which the transistor T4 and the transistor T5 are connected are the same voltage source. The control signal received by the transistor T2 is different from the control signal received by the transistor T1. The control signal received by the transistor T2 may be the reference voltage $V_{REF}$ or the initial voltage $V_{INT}$, and the gate end of the transistor T1 receives the control signal S[N], thereby completing the aforementioned first operating state.

Figure 10:
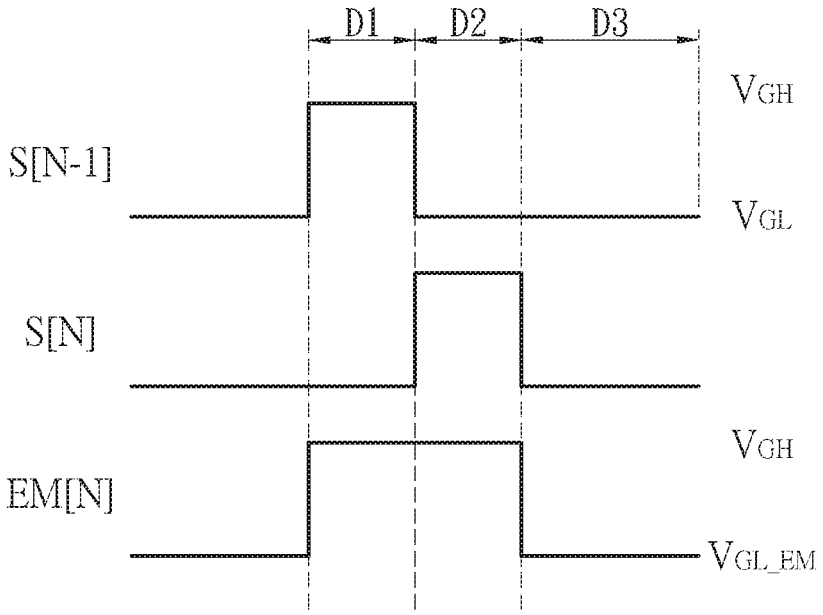
FIG. 10 is another schematic diagram of a pixel driving circuit signal.

FIG. 10 is another schematic diagram of a pixel driving circuit signal. According to the aforementioned difference, the operation waveform of the control signal is adjusted accordingly. As shown in FIG. 10, in the period D1, the control signal S[N−1] is changed from a low voltage level ($V_{GL}$) to a high voltage level ($V_{GH}$), the control signal S[N] is maintained at a low voltage level ($V_{GL}$), and the control signal EM[N] is changed from a low voltage level ($V_{GL_EM}$) to a high voltage level ($V_{GH}$). In general, in the first operating state, the waveform of the control signal EM[N] is in opposite phase with that of the control signal S[N], and the waveform of the control signal EM[N] is in phase with that of the control signal S[N−1]. Thereby the aforementioned first operating state is completed.

As shown in FIG. 10, in the period D2, the control signal S[N−1] is changed from a high voltage level ($V_{GH}$) to a low voltage level ($V_{GL}$), the control signal S[N] is changed from a low voltage level ($V_{GL}$) to a high voltage level ($V_{GH}$), and the control signal EM[N] is maintained at a high voltage level ($V_{GH}$). In general, in the second operating state, the waveform of the control signal EM[N] is in opposite phase with that of the control signal S[N−1], and the waveform of the control signal EM[N] is in phase with that of the control signal S[N]. Thereby the aforementioned second operating state is completed.

As shown in FIG. 10, in the period D3, the control signal S[N−1] is maintained at a low voltage level ($V_{GL}$), the control signal S[N] is changed from a high voltage level ($V_{GH}$) to a low voltage level ($V_{GL}$), and the control signal EM[N] is changed from a high voltage level ($V_{GH}$) to a low voltage level ($V_{GL_EM}$). Thereby the aforementioned operating flow is completed.

In addition, as described above, the control signal received by the transistor T2 may be the reference voltage $V_{REF}$ or the initial voltage $V_{INT}$. The voltage level ($V_{GL_EM}$) of the control signal EM[N] in the third operating state (i.e., light emitting phase) must be the same as the voltage level of the initial voltage (or reference voltage), and the voltage level of the initial voltage (or the voltage level of the reference voltage) is required to allow the transistor T2 and the transistor T3 to be operated in the saturation region. In addition, the bias condition of the first gate end of the transistor T2 in the second operating state (i.e., detecting phase) and the bias condition of the first gate end of the transistor T3 in the third operating state (i.e., light emitting phase) are consistent. Therefore, the threshold voltage value of the transistor T2 and the threshold voltage value of the transistor T3 are more consistent, thereby providing a better threshold voltage compensation effect.

Figure 11:
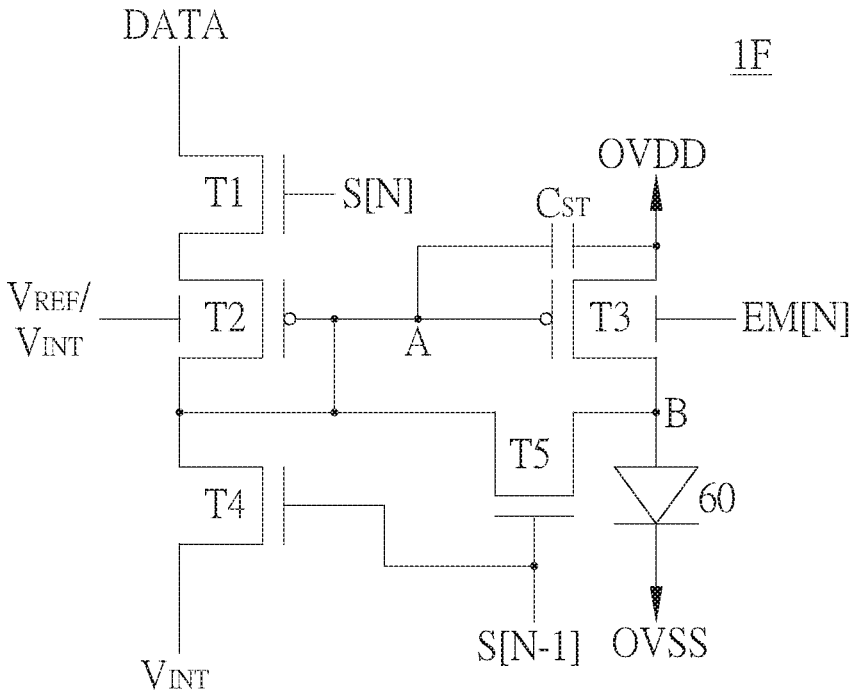
FIG. 11 to FIG. 13 are schematic diagrams of different embodiments of a pixel driving circuit.
Figure 12:
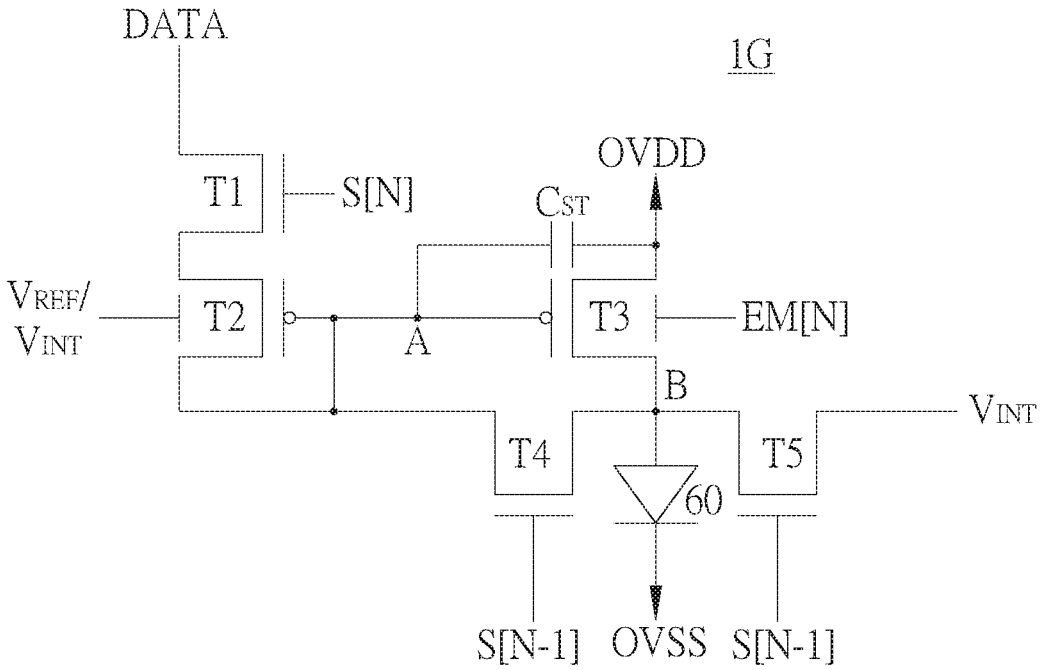
Figure 13:
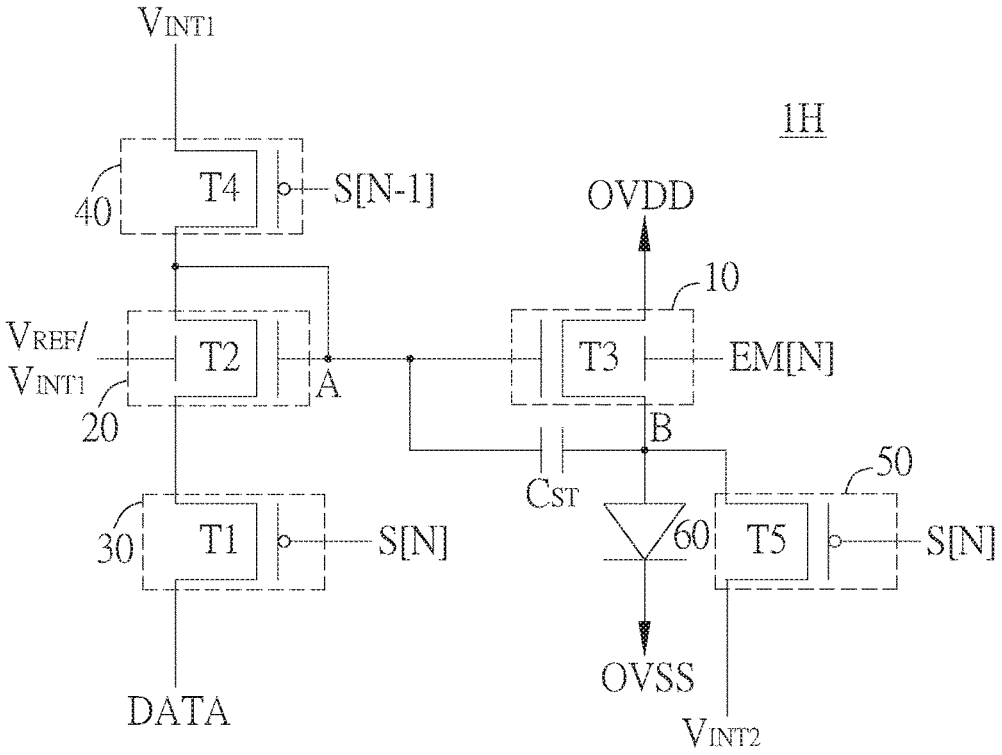

FIG. 11 to FIG. 13 are schematic diagrams of different embodiments of a pixel driving circuit. As shown in FIG. 11, the pixel driving circuit 1F includes a transistor T1, a transistor T2, a transistor T3, a transistor T4, a transistor T5, a capacitor $C_{ST}$ and a light emitting element 60. The inter-element connection relationship of the pixel driving circuit 1F illustrated in FIG. 11 is the same as the inter-element connection relationship of the pixel driving circuit 1C. The difference from the pixel driving circuit 1C is that the transistor T1, the transistor T2, the transistor T3, the transistor T4 and the transistor T5 are transistors of different types. In the embodiment shown in FIG. 11, the transistor T3 and the transistor T2 are P-type transistors, and the transistor T1, the transistor T4 and the transistor T5 are N-type transistors. In addition, in the embodiment of FIG. 11, due to the on-resistance of the two transistors, in the first operating state (i.e., resetting phase), the potential at point B after resetting is higher than the initial voltage $V_{INT}$. It should be understood that in the aforementioned case, it is still necessary to maintain the light emitting element 60 not turned on in the first operating state, that is, satisfying $VB-OVSS<V_{TH_OLED}$, where the $V_{TH_OLED}$ is the threshold voltage of the light emitting element. In addition, the control signal received by the transistor T2 is different from the control signal received by the transistor T1. The control signal received by the transistor T2 may be the reference voltage $V_{REF}$ or the initial voltage $V_{INT}$, and the gate end of the transistor T1 receives the control signal S[N].

As shown in FIG. 12, the pixel driving circuit 1G includes a transistor T1, a transistor T2, a transistor T3, a transistor T4, a transistor T5, a capacitor $C_{ST}$ and a light emitting element 60. The inter-element connection relationship of the pixel driving circuit 1G illustrated in FIG. 12 is the same as the inter-element connection relationship of the pixel driving circuit 1D. The difference from the pixel driving circuit 1D is that the transistor T1, the transistor T2, the transistor T3, the transistor T4 and the transistor T5 are transistors of different types. In the embodiment shown in FIG. 12, the transistor T3 and the transistor T2 are P-type transistors, and the transistor T1, the transistor T4 and the transistor T5 are N-type transistors. In addition, in the embodiment of FIG. 12, in the first operating state (i.e., resetting phase), the potential at point A after resetting is higher than the initial voltage $V_{INT}$. In addition, as described above, the control signal received by the transistor T2 may be the reference voltage $V_{REF}$ or the initial voltage $V_{INT}$.

As shown in FIG. 13, the pixel driving circuit 1H includes a transistor T1, a transistor T2, a transistor T3, a transistor T4, a transistor T5, a capacitor $C_{ST}$ and a light emitting element 60. The inter-element connection relationship of the pixel driving circuit 1H illustrated in FIG. 13 is substantially the same as the inter-element connection relationship of the pixel driving circuit 1A. The difference from the aforementioned embodiment is that the transistor T1, the transistor T2, the transistor T3, the transistor T4 and the transistor T5 are transistors of different types. In general, the transistor T3 and the transistor T2 are transistors of the same type, and the transistor T1, the transistor T4 and the transistor T5 are transistors of the same type but different from the transistor T3 (and the transistor T2). In the embodiment shown in FIG. 13, the transistor T3 and the transistor T2 are N-type transistors, and the transistor T1, the transistor T4 and the transistor T5 are P-type transistors. In the embodiment of FIG. 13, one end of the capacitor $C_{ST}$ is connected to the second gate end of the transistor T3, and the other end of the capacitor $C_{ST}$ is connected to the second end of the transistor T3.

Further, in the embodiment of FIG. 13, the control end of the transistor T5 is connected to the control signal S[N]. In addition, the initial voltages to which the transistor T4 and the transistor T5 are connected are different voltage sources. The second end of the transistor T4 is connected to the initial voltage $V_{INT1}$. The second end of the transistor T5 is connected to the initial voltage $V_{INT2}$. The voltage level of the initial voltage $V_{INT1}$ is greater than the voltage level of the initial voltage $V_{INT2}$. In addition, the control signal received by the transistor T2 is different from the control signal received by the transistor T1. The control signal received by the transistor T2 may be the reference voltage $V_{REF}$ or the initial voltage $V_{INT1}$, and the gate end of the transistor T1 receives the control signal S[N].

Figure 14:
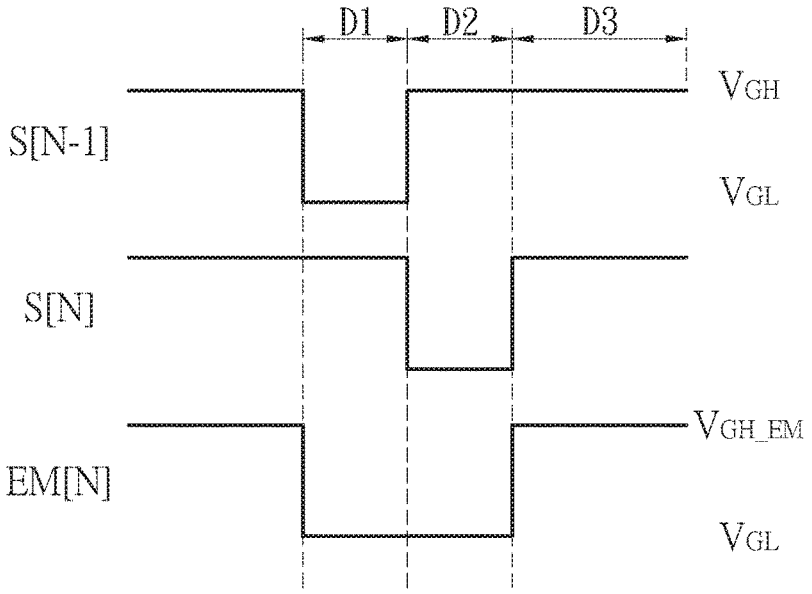
FIG. 14 is another schematic diagram of a pixel driving circuit signal.
Figure 15A:
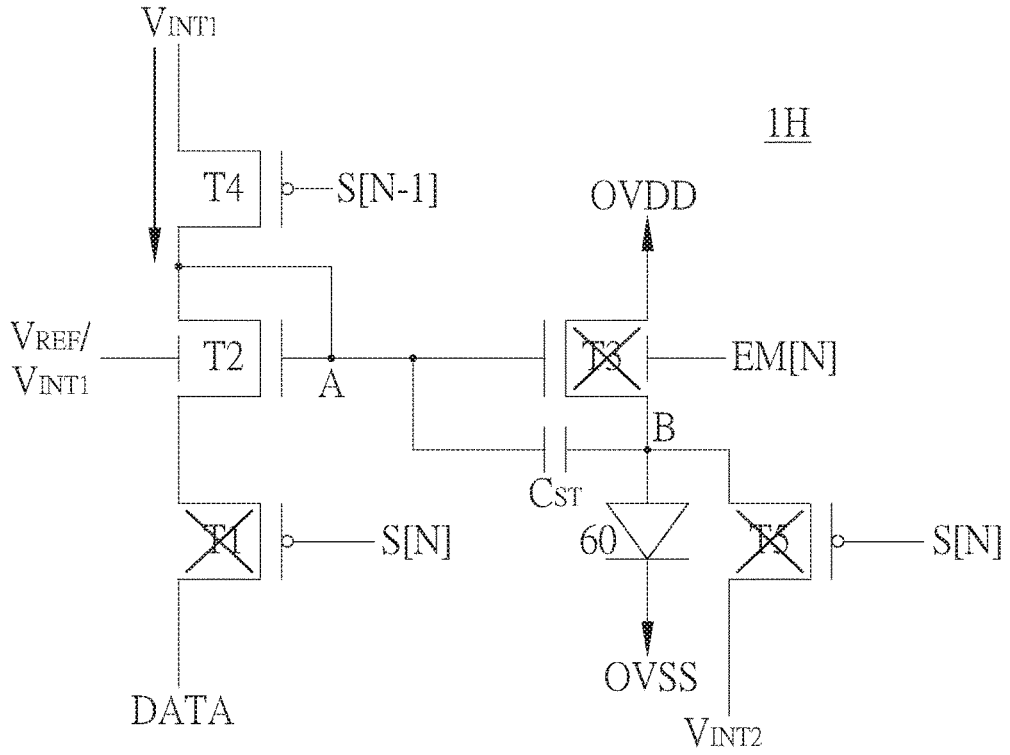
FIG. 15A to FIG. 15C are schematic diagrams illustrating the pixel driving circuit in different operation modes corresponding to FIG. 13.
Figure 15B:
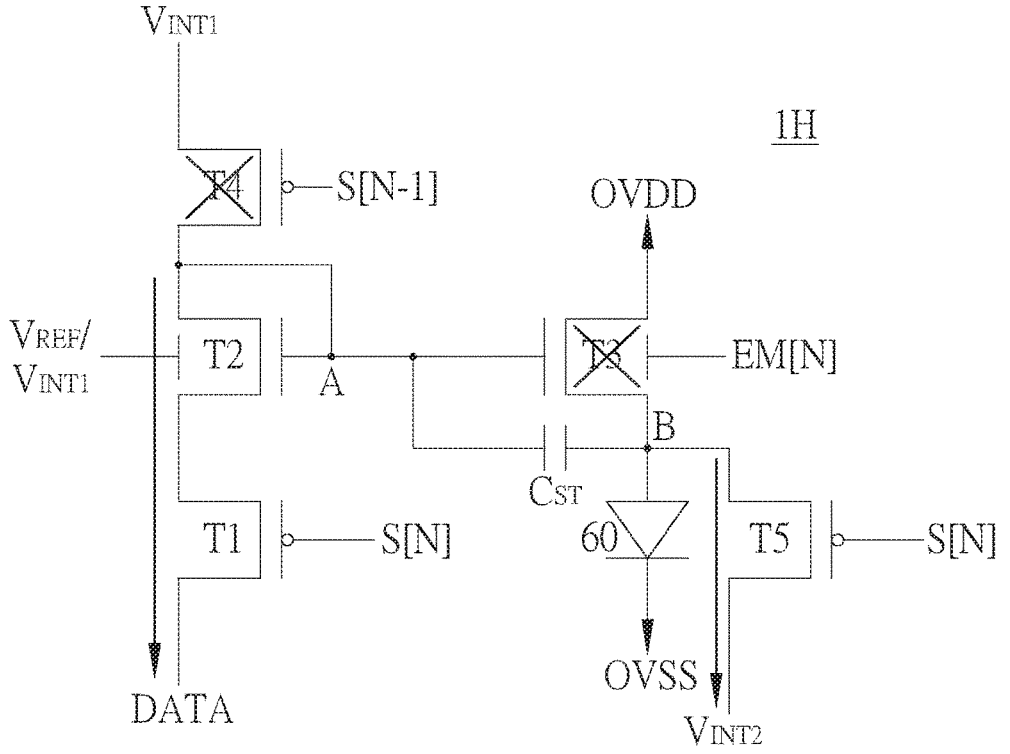
Figure 15C:
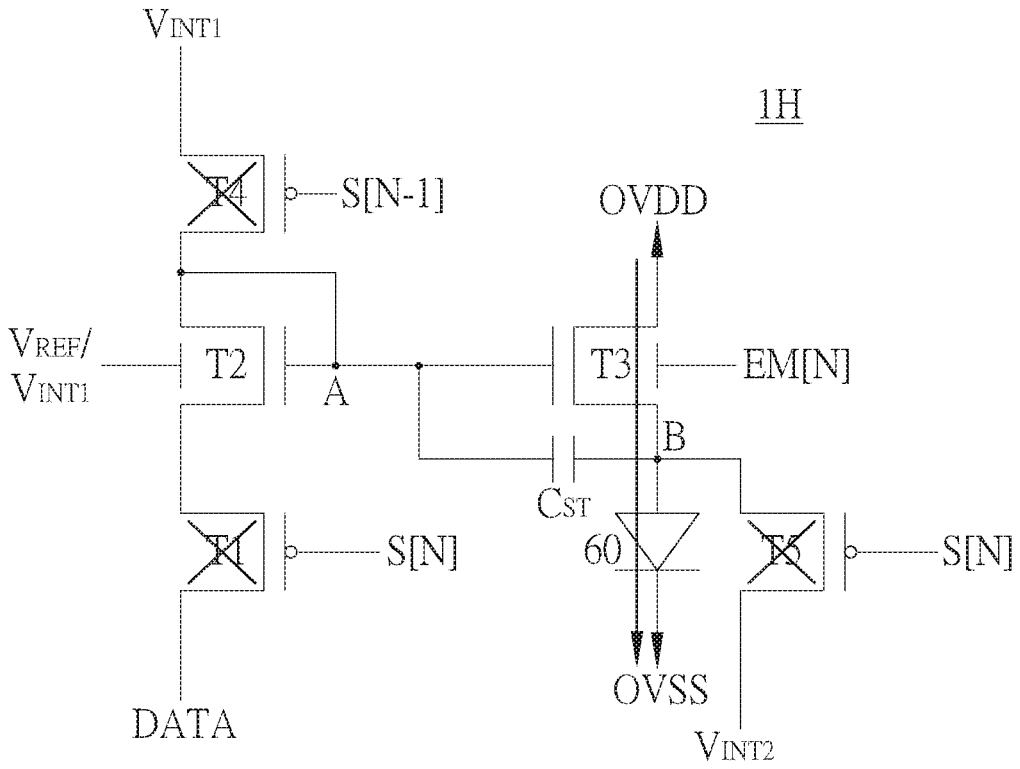

FIG. 14 is another schematic diagram of a pixel driving circuit signal. FIG. 15A to FIG. 15C are schematic diagrams showing the pixel driving circuit 1H in different operation modes corresponding to FIG. 13. According to the aforementioned difference, the operation waveform of the control signal is adjusted accordingly. Referring to FIG. 14 and FIG. 15A, in the period D1, the control signal S[N−1] is changed from a high voltage level ($V_{GH}$) to a low voltage level ($V_{GL}$), the control signal S[N] is maintained at a high voltage level ($V_{GH}$), and the control signal EM[N] is changed from a high voltage level ($V_{GH_EM}$) to a low voltage level ($V_{GL}$). In general, in the first operating state, the waveform of the control signal EM[N] is in opposite phase with that of the control signal S[N], and the waveform of the control signal EM[N] is in phase with that of the control signal S[N−1]. Thereby the aforementioned first operating state is completed.

As shown in FIG. 15A, at this time, the transistor T1, the transistor T3 and the transistor T5 are in an off state, and the transistor T2 and the transistor T4 are in an on state. Further, in the flow of the first operating state (i.e., resetting phase), the control signal S[N−1] is provided to turn on the transistor T4, and the second gate end of the transistor T3 receives the initial voltage $V_{INT1}$. As seen from another perspective (referring to FIG. 13), the second control end of the driving unit 10 is reset via the second switch unit 40. The potential at point A after resetting is equal to $V_{INT1}$.

Referring to FIG. 14 and FIG. 15B, in the period D2, the control signal S[N−1] is changed from a low voltage level ($V_{GL}$) to a high voltage level ($V_{GH}$), the control signal S[N] is changed from a high voltage level ($V_{GH}$) to a low voltage level ($V_{GL}$), and the control signal EM[N] is maintained at a low voltage level ($V_{GL}$). In general, in the second operating state, the waveform of the control signal EM[N] is in opposite phase with that of the control signal S[N−1], and the waveform of the control signal EM[N] is in phase with that of the control signal S[N]. Thereby the aforementioned second operating state is completed.

As shown in FIG. 15B, at this time, the transistor T1, the transistor T2 and the transistor T5 are in an on state, and the transistor T3 and the transistor T4 are in an off state. Further, in the flow of the second operating state (i.e., detecting phase), the control signal (for example, reference voltage $V_{REF}$) is provided to bias the transistor T2. On the other hand, the control signal S[N] is provided to turn on the transistor T1 and the transistor T5, whereby the second gate end of the transistor T3 receives the data signal DATA, and the anode end of the light emitting element 60 receives the initial voltage $V_{INT2}$. As seen from another perspective (referring to FIG. 13), the compensation unit 20 and the first switch unit 30 are turned on and the driving unit 10 is not turned on, thereby providing the data signal DATA to the second control end of the compensation unit 20, and the anode end of the light emitting element 60 is reset via the third switch unit 50. In this stage, the potential at point A is equal to DATA+$V_{th_T2}$, and the potential at point B is equal to $V_{INT2}$.

Referring to FIG. 14 and FIG. 15C, in the period D3, the control signal S[N−1] is maintained at a high voltage level ($V_{GH}$), the control signal S[N] is changed from a low voltage level ($V_{GL}$) to a high voltage level ($V_{GH}$), and the control signal EM[N] is changed from a low voltage level ($V_{GL}$) to a high voltage level ($V_{GH_EM}$). Thereby the aforementioned operating flow is completed.

As shown in FIG. 15C, at this time, the transistor T1, the transistor T4 and the transistor T5 are in an off state, and the transistor T2 and the transistor T3 are in an on state. As seen from another perspective (referring to FIG. 13), in the period D3, the first switch unit 30 is not turned on and the driving unit 10 is turned on, thereby providing a driving current to the light emitting element 60. In this stage, the potential at point A is equal to DATA+$V_{th_T2}$, and the driving current is in accordance with: $I=(½)k(DATA-V_{INT2})^2$. It should be understood that the driving current is generally related to the supply voltage and the threshold voltage value of the driving transistor, and by using the transistor T2 and the transistor T3 with the same threshold voltage value, the influence of the threshold voltage value of the transistor is eliminated in the driving current, thereby providing a stable driving current and improving the display quality.

In addition, as described above, the control signal received by the transistor T2 may be the reference voltage $V_{REF}$ or the initial voltage $V_{INT1}$. The voltage level ($V_{GH_EM}$) of the control signal EM[N] in the third operating state is the same as the voltage level of the reference voltage $V_{REF}$ (or the initial voltage $V_{INT1}$), and the voltage level of the reference voltage (or the voltage level of the initial voltage) is set such that the transistor T2 and the transistor T3 are operated in the saturation region. In addition, the bias condition of the first gate end of the transistor T2 in the second operating state (i.e., detecting phase) and the bias condition of the first gate end of the transistor T3 in the third operating state (i.e., light emitting phase) are consistent. Therefore, the threshold voltage value of the transistor T2 and the threshold voltage value of the transistor T3 are more consistent, thereby providing a better threshold voltage compensation effect.

Figure 16:
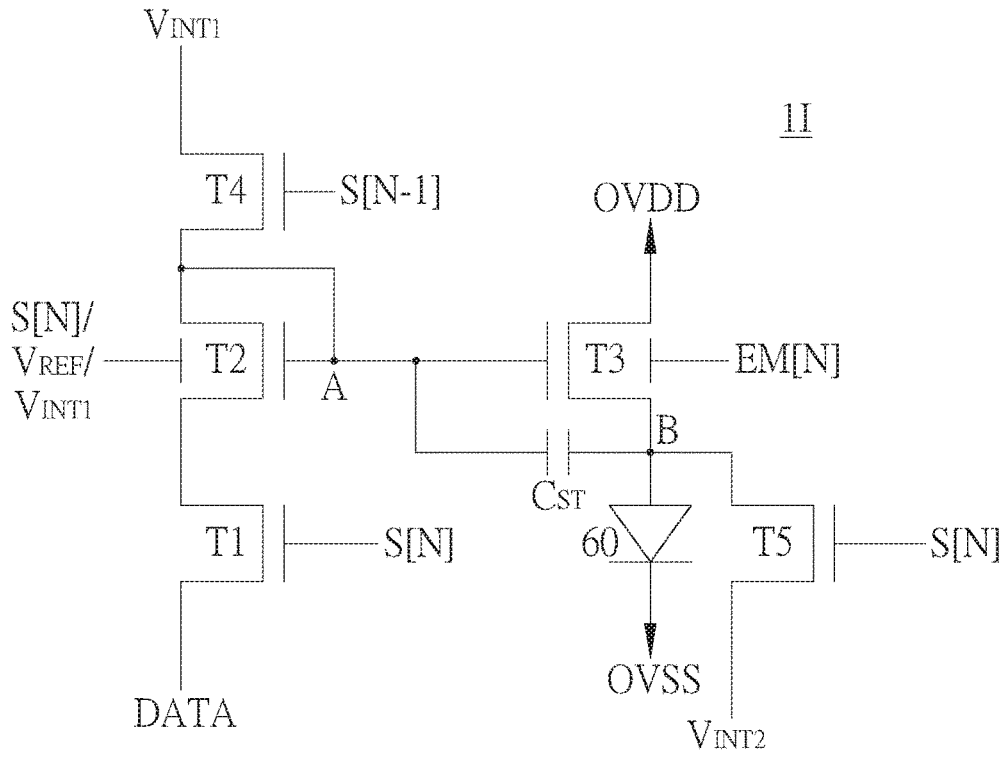
FIG. 16 is a schematic diagram of another embodiment of a pixel driving circuit.

FIG. 16 is a schematic diagram of another embodiment of a pixel driving circuit 1I. As shown in FIG. 16, the pixel driving circuit 1I includes a transistor T1, a transistor T2, a transistor T3, a transistor T4, a transistor T5, a capacitor $C_{ST}$ and a light emitting element 60. The inter-element connection relationship of the pixel driving circuit 1I illustrated in FIG. 16 is the same as the inter-element connection relationship of the pixel driving circuit 1H. The difference from the aforementioned embodiment is that the transistor T1, the transistor T2, the transistor T3, the transistor T4 and the transistor T5 are transistors of the same type. In the embodiment of FIG. 16, all the transistors are N-type transistors.

In addition, in the embodiment of FIG. 16, the initial voltages to which the transistor T4 and the transistor T5 are connected are different voltage sources. The second end of the transistor T4 is connected to the initial voltage $V_{INT1}$. The second end of the transistor T5 is connected to the initial voltage $V_{INT2}$. The voltage level of the initial voltage $V_{INT1}$ is greater than the voltage level of the initial voltage $V_{INT2}$. The case of the control signal received by the transistor T2 is similar to that of the pixel driving circuit shown in FIG. 2, that is, when the transistors of the pixel driving circuit are of the same type, the control signal received by the transistor T2 may be the same as or different from the control signal S[N] received by the transistor T1. In other words, the control signal received by the transistor T2 may be the reference voltage $V_{REF}$, the initial voltage $V_{INT1}$, or the same as the control signal received by the transistor T1.

Figure 17:
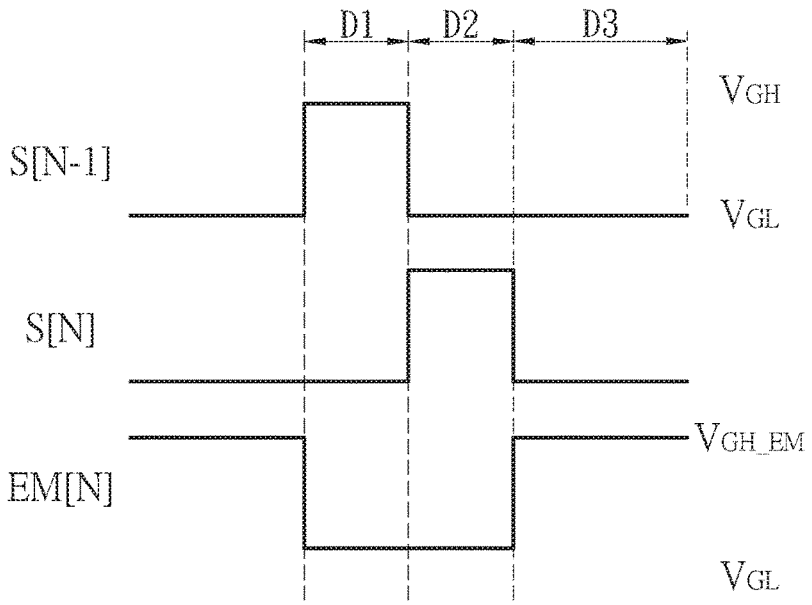
FIG. 17 is another schematic diagram of a pixel driving circuit signal.

FIG. 17 is another schematic diagram of a pixel driving circuit signal. As shown in FIG. 17, according to the aforementioned difference, the operating waveform of the control signal is adjusted accordingly. As shown in FIG. 17, in the period D1, the control signal S[N−1] is changed from a low voltage level ($V_{GL}$) to a high voltage level ($V_{GH}$), the control signal S[N] is maintained at a low voltage level ($V_{GL}$), and the control signal EM[N] is changed from a high voltage level ($V_{GH_EM}$) to a low voltage level ($V_{GL}$). In general, in the first operating state, the waveform of the control signal EM is in opposite phase with that of the control signal S[N−1]. Thereby the aforementioned first operating state is completed.

As shown in FIG. 17, in the period D2, the control signal S[N−1] is changed from a high voltage level ($V_{GH}$) to a low voltage level ($V_{GL}$), the control signal S[N] is changed from a low voltage level ($V_{GL}$) to a high voltage level ($V_{GH}$), and the control signal EM[N] is maintained at a low voltage level ($V_{GL}$). In general, in the second operating state, the waveform of the control signal EM[N] is in opposite phase with that of the control signal S[N]. Thereby the aforementioned second operating state is completed.

As shown in FIG. 17, in the period D3, the control signal S[N−1] is maintained at a low voltage level ($V_{GL}$), the control signal S[N] is changed from a high voltage level ($V_{GH}$) to a low voltage level ($V_{GL}$), and the control signal EM[N] is changed from a low voltage level ($V_{GL}$) to a high voltage level ($V_{GH_EM}$). Thereby the aforementioned operating flow is completed.

In addition, as described above, the control signal received by the transistor T2 may be the reference voltage $V_{REF}$, the initial voltage $V_{INT1}$, or the same as the control signal S[N] received by the transistor T1. When the transistor T2 receives the control signal S[N], the voltage level ($V_{GH_EM}$) of the control signal EM in the third operating state (i.e., light emitting phase) must be the same as the voltage level ($V_{GH}$) of the control signal S[N] in the second operating state. When the transistor T2 receives the initial voltage $V_{INT1}$ (or reference voltage $V_{REF}$), the voltage level ($V_{GH_EM}$) of the control signal EM[N] in the third operating state must be the same as the voltage level of the initial voltage $V_{INT1}$ (or reference voltage $V_{REF}$). The high voltage level of the control signal S[N] and the voltage level of the reference voltage $V_{REF}$ (or the voltage level of the initial voltage $V_{INT1}$) must be such that the transistor T2 and the transistor T3 are operated in the saturation region. In addition, the bias condition of the first gate end of the transistor T2 in the second operating state and the bias condition of the first gate end of the transistor T3 in the third operating state are consistent. Therefore, the threshold voltage value of the transistor T2 and the threshold voltage value of the transistor T3 are more consistent, thereby providing a better threshold voltage compensation effect.

The present invention has been described by using the foregoing related embodiments. However, the foregoing embodiments are only examples for implementing the present invention. It should be noted that the disclosed embodiments do not limit the scope of the present invention. On the contrary, the present invention is intended to cover modifications and equivalent arrangements included within the spirit and scope of the appended claims.

SYMBOL DESCRIPTION

1, 1A, 1B, 1C Pixel driving circuit
1D, 1E, 1F Pixel driving circuit
1G, 1H, 1I Pixel driving circuit
10 Driving unit
20 Compensation unit
30 First switch unit
40 Second switch unit
50 Third switch unit
60 Light emitting element
$C_{ST}$ Capacitor
DATA Data signal
EM[N] Control signal
OVDD Supply voltage
OVSS Supply voltage
S[N] Control signal
S[N−1] Control signal
T1-T5 Transistor
$V_{INT}$ Initial voltage
$V_{INT1}$, $V_{INT2}$ Initial voltage
$V_{REF}$ Reference voltage

What is claimed is:

1. A pixel driving circuit, comprising:
a first transistor, comprising:
a first end, receiving a first supply voltage;
a second end;
a first gate end, receiving a first control signal and biasing the first transistor according to the first control signal;
a second gate end;
a capacitor, wherein one end of the capacitor is connected to the second gate end of the first transistor, and the other end is connected to the first end of the first transistor or the second end of the first transistor;
a second transistor, comprising:
a first end;
a second end;
a first gate end, receiving a second control signal and biasing the second transistor according to the second control signal;
a second gate end, connected to the second end of the second transistor and connected to the second gate end of the first transistor;
a third transistor, comprising:
a first end, receiving a data signal;
a second end, connected to the first end of the second transistor;
a gate end, receiving a third control signal and turning on the third transistor according to the third control signal;
a fourth transistor, comprising:
a first end, connected to the second end of the second transistor;
a second end, connected to a first initial voltage;
a gate end, receiving a fourth control signal and turning on the fourth transistor according to the fourth control signal to reset the second gate end of the first transistor;
a fifth transistor, comprising:
a first end, connected to the second end of the first transistor;
a second end, connected to a second initial voltage;
a gate end, receiving the third control signal or the fourth control signal; and
a light emitting element, comprising:
an anode end, electrically connected to the first end of the fifth transistor, wherein the fifth transistor is turned on according to the third control signal or the fourth control signal to reset the anode end of the light emitting element;
a cathode end, receiving a second supply voltage.

2. An operating method for the pixel driving circuit according to claim 1, wherein the operating method comprises the following steps:
(A) in a first operating state, resetting the second gate end of the first transistor via the fourth transistor;
(B) in a second operating state, providing the data signal to the second gate end of the second transistor via the second transistor and the third transistor; and
(C) in a third operating state, providing a driving current to the light emitting element via the first transistor.

3. The operating method according to claim 2, further comprising:
in the first operating state, the fourth control signal is provided to turn on the fourth transistor, and the second gate end of the first transistor receives the first initial voltage; and
in the first operating state, the fourth control signal is provided to turn on the fifth transistor, and the anode end of the light emitting element receives the second initial voltage,
wherein the first transistor and the second transistor are P-type transistors, and the voltage level of the first initial voltage is the same as the voltage level of the second initial voltage; when the first transistor and the second transistor are N-type transistors, the voltage level of the first initial voltage is greater than the voltage level of the second initial voltage.

4. The operating method according to claim 2, further comprising:

in the first operating state, providing the fourth control signal to turn on the fourth transistor, the second gate end of the first transistor receiving the first initial voltage; and in the second operating state, providing the third control signal to turn on the fifth transistor, the anode end of the light emitting element receiving the second initial voltage, wherein when the first transistor and the second transistor are P-type transistors, the voltage level of the first initial voltage is the same as the voltage level of the second initial voltage; when the first transistor and the second transistor are N-type transistors, the voltage level of the first initial voltage is greater than the voltage level of the second initial voltage.

5. The operating method according to claim 2, wherein the step (B) further comprises:

providing the second control signal to turn on the second transistor; and providing the third control signal to turn on the third transistor, the second gate end of the first transistor receiving the data signal, wherein the second control signal is the same as the third control signal, and the voltage level of the first control signal in the third operating state is the same as the voltage level of the second control signal in the second operating state.

6. The operating method according to claim 2, wherein the step (B) further comprises:

providing the second control signal to bias the second transistor; and providing the third control signal to turn on the third transistor, the second gate end of the first transistor receiving the data signal, wherein the second control signal is a reference voltage different from the third control signal, and the voltage level of the first control signal in the third operating state is the same as the voltage level of the reference voltage.

7. The operating method according to claim 2, wherein the step (B) further comprises:

providing the second control signal to bias the second transistor; and providing the third control signal to turn on the third transistor, the second gate end of the first transistor receiving the data signal, wherein the second control signal is the first initial voltage different from the third control signal, and the voltage level of the first control signal in the third operating state is the same as the voltage level of the first initial voltage.

8. The pixel driving circuit according to claim 7, wherein the first transistor and the second transistor are transistors of the same type, and the third transistor, the fourth transistor and the fifth transistor are transistors of the same type and have different types from the first transistor; in a first operating state, the waveform of first control signal is in the same phase as that of the fourth control signal; and in a second operating state after the first operating state, the waveform of the first control signal is in the same phase as that of the third control signal.

9. The pixel driving circuit according to claim 8, wherein the second control signal is a reference voltage, and the voltage level of the first control signal in a third operating state after the second operating state is the same as the voltage level of the reference voltage.

10. The pixel driving circuit according to claim 8, wherein the first gate end of the second transistor is connected to the second end of the fourth transistor, the second control signal is the first initial voltage, and the voltage level of first control signal in a third operating state after the second operating state is the same as the voltage level of the first initial voltage.

11. The pixel driving circuit according to claim 7, wherein the first transistor, the second transistor, the third transistor, the fourth transistor and the fifth transistor are transistors of the same type; in a first operating state, the waveform of the first control signal is in opposite phase with that of the fourth control signal; and in a second operating state after the first operating state, the waveform of the first control signal is in opposite phase with that of the third control signal.

12. The pixel driving circuit according to claim 11, wherein the voltage level of the first control signal in a third operating state after the second operating state is the same as the voltage level of the second control signal in the second operating state.

13. The pixel driving circuit according to claim 7, wherein the first transistor and the second transistor are P-type transistors, the capacitor is connected between the second gate end of the first transistor and the first end of the first transistor, and the voltage level of the first initial voltage is the same as the voltage level of the second initial voltage.

14. The pixel driving circuit according to claim 7, wherein the first transistor and the second transistor are N-type transistors, the capacitor is connected between the second gate end of the first transistor and the second end of the first transistor, the first initial voltage is different from the second initial voltage, and the voltage level of the first initial voltage is greater than the voltage level of the second initial voltage.

15. A pixel driving circuit, comprising:

a transistor, comprising a first end, a second end, a first gate end and a second gate end, wherein the first end receives a first supply voltage, and the first gate end receives a first control signal, and turns on and biases the transistor according to the first control signal;

a capacitor, wherein one end of the capacitor is connected to the second gate end of the transistor, and the other end is connected to the first end of the transistor or the second end of the transistor;

a compensation unit, comprising a first end, a second end, a first control end and a second control end, wherein the first control end of the compensation unit receives a second control signal and biases the compensation unit according to the second control signal, and the second control end of the compensation unit is connected to the second end of the compensation unit and connected to the second control pate end of the transistor;

a first switch unit, comprising a first end, a second end and a control end, wherein the first end of the first switch unit receives a data signal, the second end of the first switch unit is connected to the first end of the compensation unit, and the control end receives a third control signal and turns on the first switch unit according to the third control signal;

a second switch unit, comprising a first end, a second end and a control end, wherein the first end of the second switch unit is connected to the second end of the compensation unit, the second end of the second switch unit is connected to a first initial voltage, and the control end receives a fourth control signal and turns on the second switch unit according to the fourth control signal;

a third switch unit, comprising a first end, a second end and a control end, wherein the first end of the third switch unit is connected to the second end of the transistor, the second end of the third switch unit is connected to a second initial voltage, the control end receives the third control signal or the fourth control signal, and the third switch unit is turned on according to the third control signal or the fourth control signal; and a light emitting element, comprising an anode end and a cathode end, wherein the anode end is connected to the second end of the transistor, and the cathode end receives a second supply voltage, wherein in a detecting phase, the compensation unit and the first switch unit are turned on and the transistor is not turned on to provide the data signal to the second control end of the compensation unit; in a light emitting phase after the detecting phase, the first switch unit is not turned on and the transistor is turned on to provide a driving current to the light emitting element.

16. The pixel driving circuit according to claim 15, wherein when the control end of the third switch unit receives the fourth control signal, in a resetting phase before the detecting phase, the second gate end of the transistor is reset via the second switch unit, and the anode end of the light emitting element is reset via the third switch unit; and when the control end of the third switch unit receives the third control signal, in a resetting phase before the detecting phase, the second gate end of the transistor is reset via the second switch unit, and the anode end of the light emitting element is reset via the third switch unit in the detecting phase.

17. The pixel driving circuit according to claim 16, wherein the transistor and the compensation unit are P-type transistors, and the voltage level of the first initial voltage is the same as the voltage level of the second initial voltage.

18. The pixel driving circuit according to claim 16, wherein the transistor and the compensation unit are N-type transistors, the voltage level of the first initial voltage is different from the voltage level of the second initial voltage, and the voltage level of the first initial voltage is greater than the voltage level of the second initial voltage.

19. The pixel driving circuit according to claim 15, wherein the voltage level of the first control signal in the light emitting phase is the same as the voltage level of the second control signal in the detecting phase.

20. The pixel driving circuit according to claim 15, wherein the second control signal is different from the third control signal, and the voltage level of the first control signal in the light emitting phase is the same as the voltage level of the second control signal.

* * * * *